United States Patent [19]

Wefers

[11] 4,387,824

[45] Jun. 14, 1983

[54] DIVIDABLE BOTTLE CONTAINER

[75] Inventor: Werner Wefers, Dortmund, Fed. Rep. of Germany

[73] Assignee: Peter Cremer, Dortmund, Fed. Rep. of Germany

[21] Appl. No.: 309,176

[22] Filed: Oct. 7, 1981

[30] Foreign Application Priority Data

Sep. 13, 1980 [DE] Fed. Rep. of Germany ..... 3034650

[51] Int. Cl.[3] ..... B65D 21/02

[52] U.S. Cl. ..... 220/23.4; 220/21; 220/94 R; 220/96

[58] Field of Search ..... 220/23.4, 21, 23.6, 220/94 R, 95, 96

[56] References Cited

U.S. PATENT DOCUMENTS

| | | | |
|---|---|---|---|
| 2,732,969 | 1/1956 | Browne | 220/23.4 |
| 3,297,196 | 1/1967 | Cornelius | 220/23.4 |
| 3,317,081 | 5/1967 | Cornelius | 220/23.4 |
| 3,603,475 | 9/1971 | Friedman | 220/23.4 |

FOREIGN PATENT DOCUMENTS

| | | | |
|---|---|---|---|
| 2525169 | 9/1976 | Fed. Rep. of Germany | 220/23.4 |

*Primary Examiner*—George E. Lowrance
*Attorney, Agent, or Firm*—Max Fogiel

[57] ABSTRACT

A two-part synthetic bottle container, in which a dividing wall extends parallel to an outer wall, and interengaging locking elements are provided in the form of hooks which project in the region of one corner of an abutment surface past dividing members. The locking elements have recesses located in the region of the other corner and corresponding to the hook cross section. Surface portions of a slider extend behind hooks of a corresponding container part, when in a locking position. The container parts have at their narrow sides carrying brackets which are pivotable relative to the container parts. The carrying brackets, furthermore, project with free ends of their legs past the pivot joint of the brackets and container parts. The carrying brackets are provided at the free end, with an abutment, so that when the brackets are pivoted against the container parts, they extend with this abutment through a recess in the wall of a corresponding locking compartment and engage in a recess in the latching slider, for the purpose of lifting this slider to a latching position.

8 Claims, 4 Drawing Figures

DIVIDABLE BOTTLE CONTAINER

BACKGROUND OF THE INVENTION

The invention relates to a multi-partite, particularly a two-part synthetic bottle container with a division extending parallel to an outer wall, auxiliary walls which limit partial pieces and interengaging locking elements in form of a plurality of hooks which project in the repair of one corner of the abutment surface past the partial pieces and of recesses located in the region of the other corner, terminating in a space and corresponding to the hook crop-section, whereby in the space there is arranged a slider having surface portions which in the locking position extend behind the hooks of the corresponding container part which project into the space, and the container parts have at the narrow sides carrying brackets pivoted thereto and pivotable relative to the carrying brackets, which project with the free ends of their legs past the pivotal connection.

A divisibility of commercially available bottle containers for example those accepting 20½ l. beer bottles, is desired to make handling—particularly transportation away from the selling point—easier for the end user. However, the divisibility is not to adversely influence the handling of such containers by the bottler, e.g. the brewery, and the seller.

Suggestions made in the past for divisibility of bottle containers (e.g.-U.S. Pat. No. 2,311,723; U.S. Pat. No. 2,610,760) have not been adopted, in particular because the combining and separating of the container dividing pieces is effected by a special locking respectively unlocking operation. For the same reason more recent suggestions (German Gebrauchsmuster Nos. 7,518,030 and 7,923,328) have also been realized.

Starting with the bottle container according to German Gebrauchsmuster No. 7,923,328, which has the features outlined in the preamble of claim 1, the purpose of the invention is to construct such a bottle container, and particularly the latching of such a bottle container, that the separation and reaggregation of the individual container parts can be carried out more easily.

Inventively, the task is solved with a divisible bottle container of the type described in the beginning, which is characterized in that the carrying brackets provided at the free end of a leg with an abutment, enter—when pivoted towards the container—with this abutment a recess in the wall of the corresponding locking space and engage in a recess in the locking slide to lift the same to locking position.

Unlocking is thereby effected by lifting of the brackets which are associated with each of the container parts and which are then also available for easy transport of the container parts. The unity of two container parts to form a container is readily possible with raised brackets, which are then locked to each other by folding down the brackets.

It is advantageous if in the folded-in condition the brackets enter into a recess of the container parts. In combination with the fact that the container parts are provided in the bottom region along the abutment with a recess which includes the locking space and in the assembled container forms a through-going slot; this combination assures proper stackability of such containers.

The slider is inserted into the overhead-closed space from the open bottle side, whereby a spring-loaded latch initiated in the space and extending behind the slides assures that the slider does not slip out of the space.

The slider is profiled and has longitudinal grooves into which guide rails engage which extend from the appropriately configurated space.

The space receiving the slider may project slightly beyond the auxiliary wall and the region provided with the locking hooks may be correspondingly recessed, so as not too strongly to reduce the available space of the container part in the repair of the space. This is aided if the profiled slider and thus also the space receiving the slider have an approximately trapezoidal cross-section, with the short leg of the trapezium corresponding approximately to the thickness of the container wall which it abuts.

The bracket is preferably provided with integral pins which are receivable in elongated holes provided in the corresponding wall parts of the container part. A limitation of the bracket pivoting angle can be provided by an abutment on the container part.

It can further be provided that in the locking position, i.e. in the position in which it is pivoted against the container part, the bracket is fixed to the container part in a manner which excludes an automatic unlatching, e.g. by snapping of a cam at the inner side of the bracket into a corresponding recess in the wall of the container part.

The invention is further illustrated in the drawing by way of an exemplary embodiment.

Figure 1:
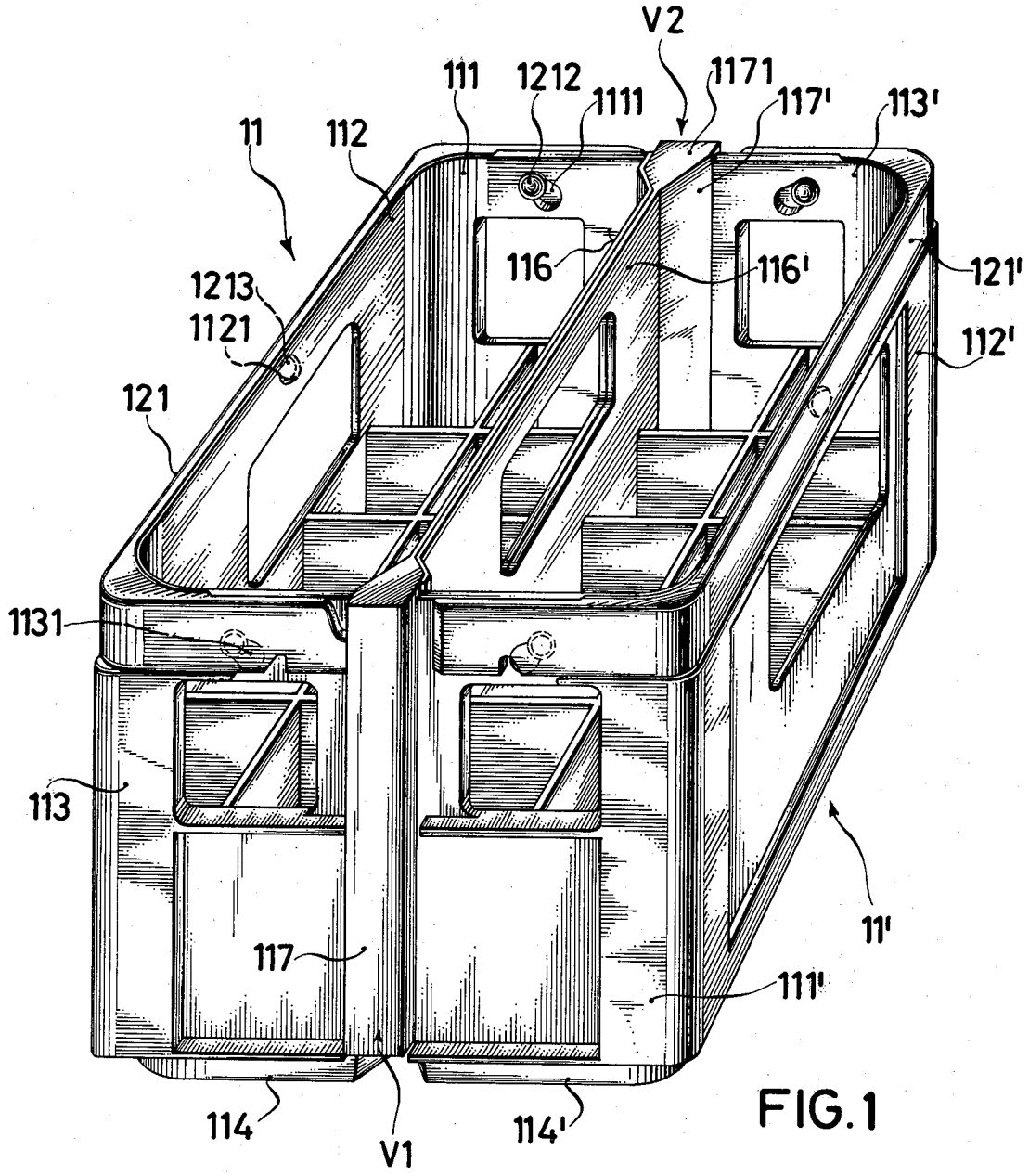
FIG. 1 shows the new bottle container in a perspective view.

The container is composed of the parts 11 and 11*a* with the outer walls 111, 112, 113 respectively 111', 112', 113', the bottom 114 respectively 114' and the auxiliary walls 116 respectively 116' which abut one another (FIG. 1) when the parts 11, 11' are united to form the container.

The wall—and possibly also the bottom elements 111, 111', to 116, 116' are provided in known manner with cut-outs or recesses. Also, in known manner the parts 11, 11' are subdivided into a plurality of compartments each receiving a bottle or the like.

Figure 2:
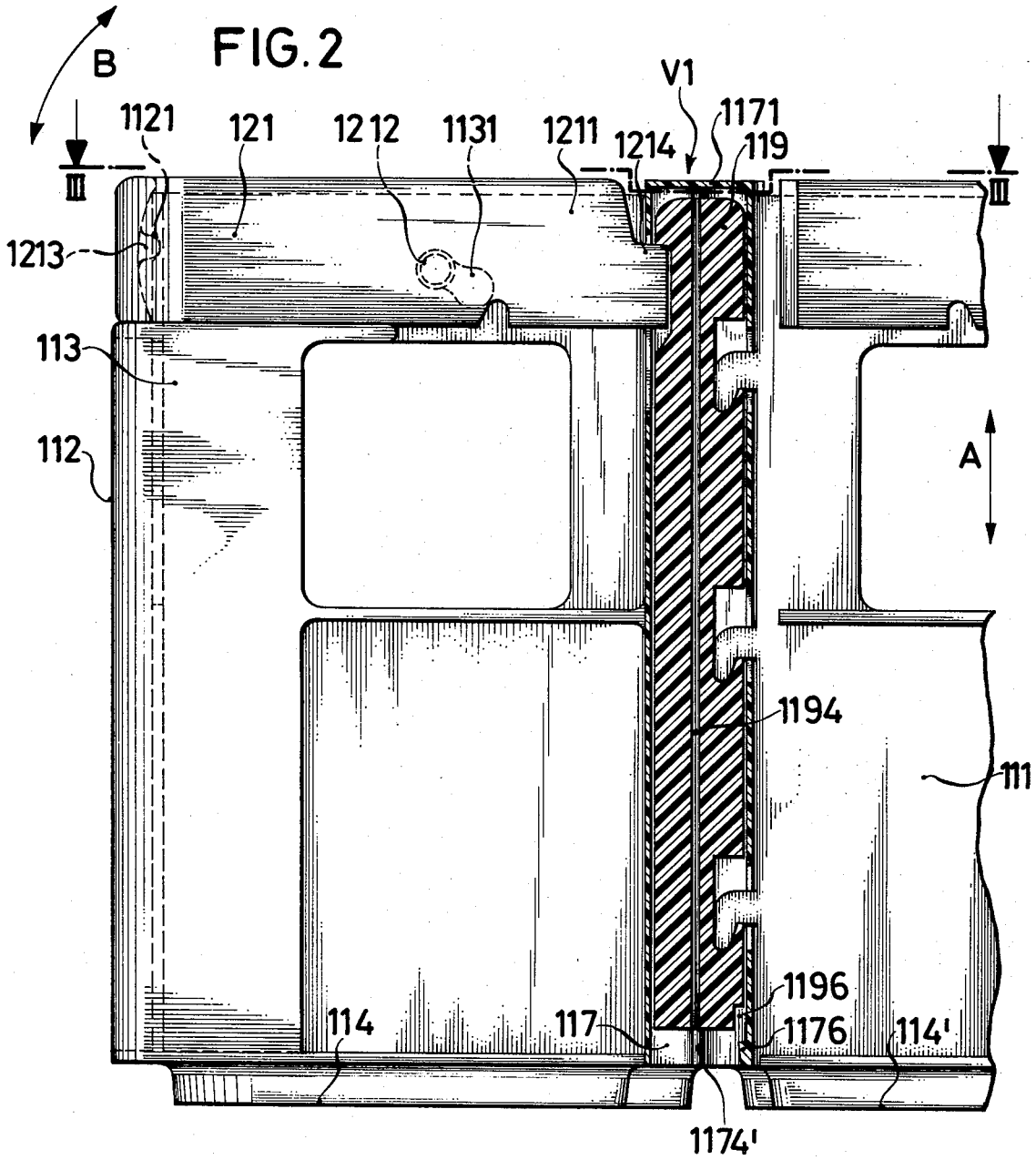
FIG. 2 is a broken-away view of the container in the direction of arrow 11 of FIG. 1, with the latching region broken open.
Figure 3:
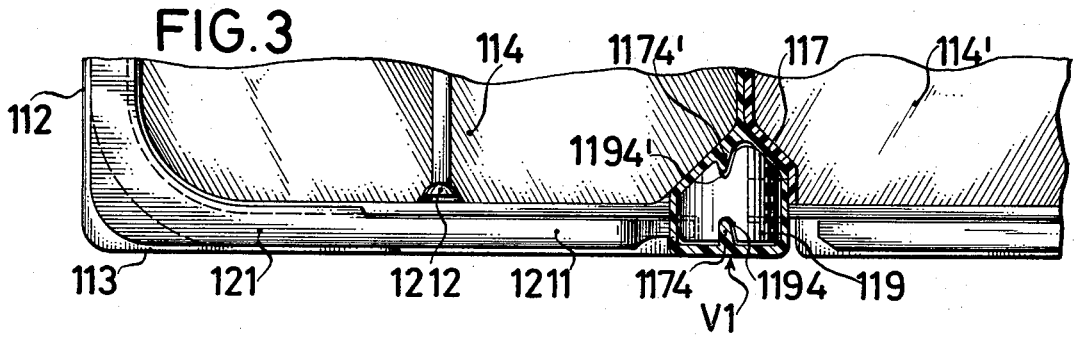
FIG. 3 is a section on line 111—111 of FIG. 2.
Figure 4:
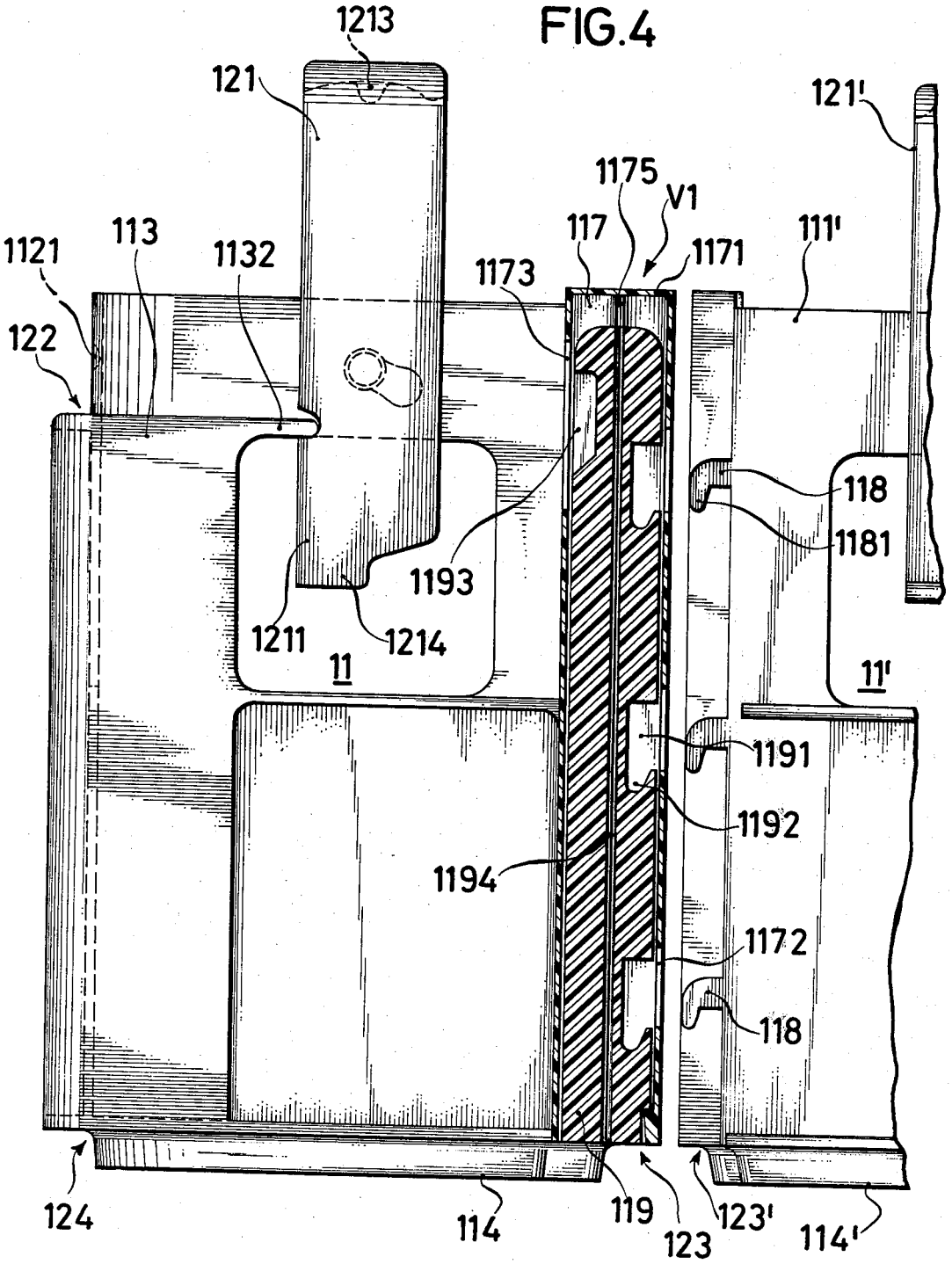
FIG. 4 is a view corresponding to FIG. 2 but sharing the container in unlatched condition.

At the transition of the auxiliary walls 116, 116' into an outer wall 113, 113' each part 11, 11' is provided with a space 117, 117' extending over the height of the container, closed at the top (117') and at the transition of the auxiliary walls 116, 116' into the other outer wall 111, 111' with a plurality of hooks spaced from one another, projecting beyond the auxiliary walls 116, 116' and having downwardly directed claws 118', of which FIGS. 2 to 4 shows the hooks 118' which project from the part 113'.

The latching mechanism is further explained with reference to the latch V1 shown in detail in FIGS. 2 to 4. The latch V2 located at the opposite side is correspondingly constructed.

At the level of the hooks 118' which form part of the container part 11' the wall of the space 17 formed in the corresponding part 11 is provided with recesses 1172 (especially FIG. 4) through which the hooks 118' projecting from part 11' extend when the parts 11 and 11' are placed together. A slider 119 shiftable in the space 117 in the direction of the double-headed arrow A of FIG. 2 is provided, at spacings corresponding to the hook distances, with recesses 119' (especially FIG. 4) into which the hooks 118' enter when the parts 11, 11' are placed together. The recesses 119' in slider 119 merge at the bottom side into a blind depression 1192 (especially FIG. 4) into which at raised slider (FIG. 2) the claw 1181 of the hooks 118' enters, whereby latching of the parts 11, 11' with one another is effected.

Raising and holding of the slider 119 in latching position (FIG. 2) is effected by the bracket 121 associated with the part 11. The bracket 121 is pivoted at 1111 and 1131 to the part 11 in the sense of the double-headed arrow B; its projection 1211 which extends beyond the pivoting 1131 extends through a recess 1173 (especially FIG. 4) in the facing wall of the space 117, extends beneath a recess 1193 (especially FIG. 4) in slider 119 and on pivoting towards the part 11 transfers the slider 119 into the latching position in which it then holds it (FIG. 2).

For disengagement the bracket 121 is lifted (FIG. 4) and the slider 119 which readily moves in the space 117 slides downwardly whereby the components of the hooks 118' formed on the other part 11' are released, so that the parts 11 and 11' can be separated. The bracket 121 forming part of the container part 11 is then furthermore available for transportation of the container part 11, just as the bracket 121' which forms part of the container part 11' and effects unlatching of the latch V2.

The slider 119, which has essentially a trapezoidal cross-section, is provided with two longitudinal grooves 1194, 1194' into which guide rails 1174, 1174' engage (FIG. 3) which extend into the space 117. At the bottom a lock 1176, 1196 prevents sliding-out of the bottom-inserted slider from the space 117 (especially FIG. 2).

The brackets 121, 121' pivoted towards the container parts 11, 11' enter flush into appropriate recesses at the circumference of the container parts 11, 11' for example 122. Recesses 123, 123' at the bottom 114, 114' of the container parts 11, 11' in conjunction with known-perse recesses 124 at the container circumference assure proper stackability of the container.

The brackets 121, 121' have integrally formed pins, e.g. 121 in FIGS. 2 and 3, which enter into therefore provided slots, e.g. 1131 in FIG. 2. Abutments, e.g. 1132 in FIG. 4 on the container parts 11, 11' limit the pivoting range of the brackets 121, 121' in such a manner that at maximum they can be pivoted to the position shown in FIG. 4.

In the position in which they are pivoted against the container parts 11, 11' (FIGS. 1–3) the brackets 121, 121' are fixed by cams 1213 which are formed on the brackets 121, 121' and snap into appropriate recesses 1121 in the container wall 112.

I claim:

1. A two-part synthetic bottle container, comprising: an outer wall; a division wall extending parallel to said outer wall, dividing elements and interengaging locking elements in form of a plurality of hooks projecting in the region of one corner of an abutment surface past the dividing elements, said locking elements having recesses located in the region of the other corner and corresponding to the hook cross-section, a slider having surface portions which in a locking position extend behind hooks of a corresponding container part, carrying brackets pivoted with pivot means on parts of the container at narrow sides thereof, and pivotable relative to the container parts, said carrying brackets having free end projecting past said pivot means, said carrying brackets having an abutment at the free end thereof; said carrying brackets, when pivoted against the container parts, extending with said abutment through a recess in the wall of a corresponding locking compartment and engaging in a recess in said slider to lift said slider to a latching position.

2. Container according to claim 1, wherein a bracket enters flush into a recess formed in the container part.

3. Container according to claim 1, wherein said container parts are in a bottom region along the abutment with a recess forming in the assembled container a throughgoing slot including latching space.

4. Container according to claim 1, including a latch extending behind the slider inserted into a space open at the bottom.

5. Container according to claim 1, including a profiled slide filling a corresponding space having guide rails projecting into the space and longitudinally extending grooves.

6. Container according to claim 1, wherein said brackets have integrally formed pins engageable in slots formed in the said parts.

7. Container according to claim 1, including a pivot limiting arrangement for said brackets and comprising abutments on said parts.

8. Container according to claim 1, wherein said brackets snap into said parts in latching position.

* * * * *